US005932319A

United States Patent [19]

Makar et al.

[11] Patent Number: 5,932,319

[45] Date of Patent: Aug. 3, 1999

[54] HEAT-TRANSFER LABEL

[75] Inventors: Onsy Y. Makar, Framingham; Samuel H. Stein, Westborough, both of Mass.

[73] Assignee: Avery Dennison Corporation, Pasadena, Calif.

[21] Appl. No.: 08/885,979

[22] Filed: Jun. 30, 1997

[51] Int. Cl.[6] ..... B41M 3/00

[52] U.S. Cl. ..... 428/195; 428/212; 428/352; 428/354; 428/355 R; 428/474.4; 428/474.7; 428/480; 428/484; 428/500; 428/913; 428/914

[58] Field of Search ..... 428/195, 484, 428/488.4, 482, 532, 913, 914, 212, 480, 500, 343, 352, 354, 355 R, 474.4, 474.7

[56] References Cited

U.S. PATENT DOCUMENTS

| | | |
|---|---|---|
| 3,922,435 | 11/1975 | Asnes . |
| 4,426,422 | 1/1984 | Daniels . |
| 4,548,857 | 10/1985 | Galante . |
| 4,935,300 | 6/1990 | Parker et al. . |

OTHER PUBLICATIONS

Technical literature for ViTEL 2300 polyester resin (Bostik, Middleton MA), publicly available before the filing of the present application.

Technical literature for CYMEL 300 melamine resin (American Cyanamid), publicly availabe before the filing of the present application.

Technical literature for ViTEL 5545 polyester resin (Bostik, Middleton MA), publicly available before the filing of the present application.

Technical literature for CYCAT 4040 catalyst (Cytec Indus. Inc., West Paterson, NJ), published Feb. 15, 1994.

Technical literature for VAGH vinyl resin (Union Carbide Chemicals, Danbury, CT), publicly available before the filing of the present application.

*Primary Examiner*—Pamela R. Schwartz
*Attorney, Agent, or Firm*—Kriegsman & Kriegsman

[57] ABSTRACT

A heat-transfer label that is particularly well-suited for decorating treated low-density polyethylene (LDPE) containers and that exhibits strong resistance to degradation from animal fats and the like, even when subjected to flexing. In a preferred embodiment, the label includes a support, a wax release layer over the support and a transfer portion over the wax release layer. The transfer portion includes a protective lacquer layer, the protective lacquer layer comprising a pair of cross-linked polyester resins and a cross-linked vinyl resin, each of said cross-linked resins being cross-linked by a hexamethoxymethylmelamine resin. The transfer portion also includes an ink layer over the protective lacquer layer, the ink layer comprising a polyamide ink. The transfer portion further includes an adhesive layer over the ink layer, the adhesive layer comprising nitrocellulose and a soft polyamide resin.

25 Claims, 1 Drawing Sheet

HEAT-TRANSFER LABEL

BACKGROUND OF THE INVENTION

The present invention relates generally to heat-transfer labels and more particularly to a novel heat-transfer label particularly well-suited for use on treated low-density polyethylene surfaces and the like.

Heat-transfer labels are commonly used in the decorating and/or labelling of commercial articles, such as, and without limitation to, containers for beverages, essential oils, detergents, adverse chemicals, and health and beauty aids, as well as flat surfaces. As can readily be appreciated, heat-transfer labels are desirably resistant to abrasion and chemical effects in order to avoid a loss of label information and desirably possess good adhesion to the articles to which they are affixed.

One well-known type of heat-transfer label is described in U.S. Pat. No. 3,616,015, inventor Kingston, which issued October, 1971, and which is incorporated herein by reference. In the aforementioned patent, there is disclosed a heat-transfer label comprising a paper sheet or web, a wax release layer affixed to the paper sheet, and an ink design layer printed on the wax release layer. In the heat-transfer labelling process, the label-carrying web is subjected to heat, and the label is pressed onto an article with the ink design layer making direct contact with the article. As the paper sheet is subjected to heat, the wax layer begins to melt so that the paper sheet can be released from the ink design layer, a portion of the wax layer being transferred with the ink design layer and a portion of the wax layer remaining with the paper sheet. After transfer of the design to the article, the paper sheet is immediately removed, leaving the design firmly affixed to the article and the wax transferred therewith exposed to the environment. The wax layer is thus intended to serve two purposes: (1) to provide release of the ink design from the web upon application of heat to the web and (2) to form a protective layer over the transferred ink design. After transfer of the label to the article, the transferred wax release layer is typically subjected to a post-flaming technique which enhances the optical clarity of the wax protective layer (thereby enabling the ink design layer therebeneath to be better observed) and which enhances the protective properties of the transferred wax release.

In some heat-transfer labels, an adhesive layer (e.g., solvent-soluble polyamide, acrylic or polyester) is deposited over the ink design to facilitate adhesion of the label onto a receiving article. An example of a heat-transfer label having an adhesive layer is disclosed in U.S. Pat. No. 4,548,857, inventor Galante, which issued Oct. 22, 1985, and which is incorporated herein by reference. Additionally, in some heat-transfer labels, a protective lacquer layer is interposed between the wax release layer and the ink layer. An example of such a label is disclosed in U.S. Pat. No. 4,426,422, inventor Daniels, which issued Jan. 17, 1984, and which is incorporated herein by reference.

Heat-transfer labels of the types described above have been used to decorate a variety of articles, including low-density polyethylene (LDPE) containers. One example of a heat-transfer label which has been made and used by the assignee of the present application to decorate an LDPE container comprises a paper carrier web overcoated with a wax release layer (approximately 6–8 lbs. wax/3000 square feet of paper carrier web). A protective lacquer layer is printed on the wax release layer, the protective lacquer layer comprising a pair of cross-linked polyester resins. An ink design layer comprising a polyamide resin is printed on the protective lacquer layer. A heat-activatable adhesive layer comprising a polyamide resin and nitrocellulose is printed on the ink design layer.

Prior to transfer of the aforementioned label to the LDPE container, the container must be treated by some oxidizing technique so that the label will adhere to the container surface. Typical oxidizing techniques include subjecting the polyethylene surface to corona discharge or flaming the surface with an oxidizing flame. Without wishing to be limited to any particular theory as to why pre-treatment of the polyethylene surface is necessary for the aforementioned label to adhere thereto, it is believed that untreated polyethylene is a low energy surface made up primarily of hydrocarbons whereas oxidized or treated polyethylene is a relatively higher energy surface which additionally includes ketones, carboxylic acid groups, etc. Accordingly, because the pre-treated polyethylene surface is a higher energy surface than the untreated polyethylene surface, it is more receptive to binding to the adhesive layer of the above-described label.

The aforementioned label, once applied to a treated low-density polyethylene container, does not suffer degradation and separation from its associated polyethylene surface when the labelled polyethylene surface is "wet-flexed." "Wet-flexing" typically comprises soaking a labelled polyethylene container in a cool water bath having a sonicator for about 20 minutes, repeatedly squeezing or bending the container for a period of time, and then subjecting the container to a "tape test." A "tape test," which can be performed independently of any prior wet-flexing, involves applying a strip of adhesive tape (such as 610 adhesive tape, which is commercially available from 3M) to the label, removing the strip of tape from the container, and then visually assessing the integrity of the label. As can readily be appreciated, the inability of a label to withstand "wet-flexing" limits the usefulness of such a label on polyethylene containers of the type that are frequently squeezed under wet conditions.

Although the above-described label does withstand "wet-flex" on treated LDPE surfaces, said label readily suffers degradation and separation from its associated LDPE surface once said label is contacted with animal fats, oils or the like, and the surface is subjected to flexing. As can readily be appreciated, this problem limits the usefulness of such labels on containers for items that are frequently squeezed by users having greasy hands.

SUMMARY OF THE INVENTION

It is an object of the present invention to provide a novel heat-transfer label.

It is another object of the present invention to provide a heat-transfer label as described above that is well-suited for use on treated low-density polyethylene surfaces.

It is yet another object of the present invention to provide a heat-transfer label as described above that possesses good "wet-flex" when applied to treated low-density polyethylene surfaces.

It is still yet another object of the present invention to provide a heat-transfer label as described above that does not readily become degraded and separated from a treated low-density polyethylene surface after said label has been contacted with animal fats, oils or the like, and said surface is flexed.

Additional objects, as well as features, advantages and aspects, of the present invention will be set forth in part in the description which follows, and in part will be obvious from the description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

In furtherance of the above and other objects that are herein disclosed or are apparent from the present specification, there is provided a heat-transfer label for use on an article, the heat-transfer label comprising (a) a support; (b) a wax release layer over said support; and (c) a transfer portion over said wax release layer to be transferred from the support to an article upon application of heat to the support while the transfer portion is in contact with the article, said transfer portion comprising (i) a protective lacquer layer, said protective lacquer layer comprising a first cross-linked polyester resin and a cross-linked vinyl resin, (ii) an ink layer over said protective lacquer layer, and (iii) an adhesive layer over said ink layer.

In a preferred embodiment, the aforementioned heat-transfer label is particularly well-suited for use on treated low-density polyethylene containers. In said preferred embodiment, said ink layer preferably comprises a polyamide ink, and said adhesive layer preferably comprises nitrocellulose and a polyamide resin, the polyamide resin being a clear alcohol soluble soft polyamide resin of the type that is based on dimerized vegetable acid and aliphatic polyamines and that has a Brookfield viscosity at 160° C. of 4–7 poise, a softening point of 105–115° C. and a Gardner color (maximum) of 7.

In addition to said first cross-linked polyester resin and said cross-linked vinyl resin, said protective lacquer layer preferably further comprises a second cross-linked polyester resin. Said cross-linked vinyl resin preferably comprises a vinyl resin of the type commercially available as VAGH vinyl resin and a cross-linker, such as a melamine resin, more preferably a hexamethoxymethylmelamine resin of the type commercially available as CYMEL 303 melamine resin. One of said two cross-linked polyester resins preferably comprises a first polyester resin of the type commercially available as ViTEL® 2300 polyester resin and a cross-linker, such as a melamine resin, more preferably a hexamethoxymethylmelamine resin of the type commercially available as CYMEL 303 melamine resin. The other of said two cross-linked polyester resins preferably comprises a second polyester resin of the type commercially available as ViTEL® 5545 polyester resin and a cross-linker, such as a melamine resin, more preferably a hexamethoxymethylmelamine resin of the type commercially available as CYMEL 303 melamine resin. In making the protective lacquer layer, the ViTEL® 2300 and 5545 polyester resins are preferably added in a 3 to 1 ratio, respectively, by weight, and the vinyl resin is preferably added in an amount, by weight, approximately equal to the combined weights of the ViTEL® 2300 and 5545 polyester resins.

In addition to being directed to the above-described heat-transfer label, the present invention is also directed to the transfer portion of the heat-transfer label, as well as to the protective lacquer layer of the transfer portion, to a protective lacquer composition for use in forming the protective lacquer layer, to a method of labelling a treated low-density polyethylene surface with the above-described heat-transfer label and to a treated low-density polyethylene surface decorated with said label.

For purposes of the present specification and claims, it is to be understood that certain terms used herein, such as "on" or "over," when used to denote the relative positions of two or more layers of a heat-transfer label, are primarily used to denote such relative positions in the context of how those layers are situated prior to transfer of the transfer portion of the label to an article since, after transfer, the arrangement of layers is inverted as those layers which were furthest removed from the associated support sheet are now closest to the labelled article.

BRIEF DESCRIPTION OF THE DRAWINGS

The accompanying drawings, which are hereby incorporated into and constitute a part of this specification, illustrate preferred embodiments of the invention and, together with the description, serve to explain the principles of the invention. In the drawings wherein like reference numerals represent like parts.

DETAILED DESCRIPTION OF PREFERRED EMBODIMENTS

Figure 1:
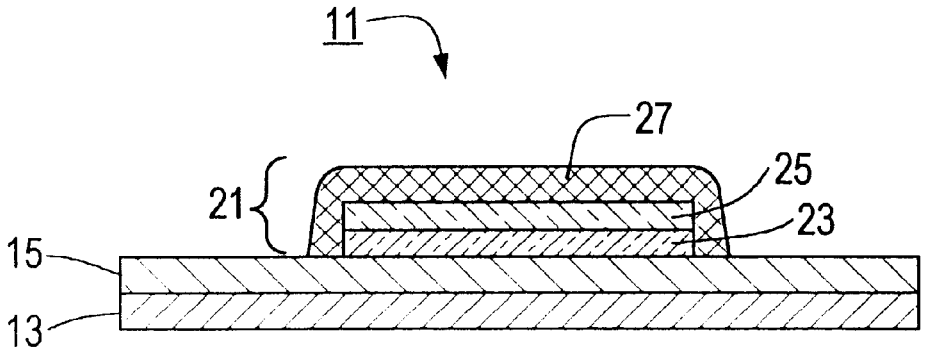
FIG. 1 PRIOR ART
FIG. 1 is a schematic section view of a prior art heat-transfer label that is particularly well-suited for use with treated low-density polyethylene surfaces.

Referring now to FIG. 1, there is shown a schematic section view of a prior art heat-transfer label that is particularly well-suited for use on treated low-density polyethylene surfaces, particularly treated LDPE containers, the heat-transfer label being represented generally by reference numeral 11.

Prior art label 11, which has been used by the assignee of the present application to decorate treated LDPE containers, comprises a support 13 in the form of a paper carrier web. Label 11 also comprises a conventional wax release layer 15, which is overcoated onto support 13 at approximately 6–8 lbs. wax/3000 square feet of support. During label transfer, as wax release layer 15 melts or softens, a portion of wax release layer 15 is transferred along with the transfer portion of label 11 onto the article being labelled and a portion of wax release layer 15 remains behind on support 13.

Label 11 further comprises a transfer portion 21. Transfer portion 21, in turn, includes a protective lacquer layer 23 printed directly on top of at least a portion of wax release layer 15, an ink design layer 25 printed onto a desired area of lacquer layer 23, and a heat-activatable adhesive layer 27 printed over design layer 25 and onto a surrounding portion of wax release layer 15.

Protective lacquer layer 23 comprises two cross-linked polyester resins. One of said cross-linked polyester resins comprises ViTEL® 2300 polyester resin (a copolyester resin commercially available from Bostik, Middleton, Mass., and having a high tensile strength of 8000 psi, a low elongation of 7%, a 79 D scale Shore Durometer hardness, and a 156° C. ring and ball melt flow point) and a cross-linker in the form of CYMEL 303 hexamethoxymethylmelamine resin (a commercial grade of hexamethoxymethylmelamine available in liquid form at 100% non-volatile from American Cyanamid).

The other of said cross-linked polyester resins comprises ViTEL® 5545 polyester resin (an amber thermoplastic, high molecular weight, linear saturated polyester resin also commercially available from Bostik, said resin being a highly flexible amorphous polymer, tacky at room temperature, with high elongation and low tensile values) and a cross-linker in the form of CYMEL 303 hexamethoxymethylmelamine resin. As will hereinafter be seen, in forming protective lacquer layer 23, said ViTEL® 2300 and ViTEL® 5545 resins are added in a 3:1 ratio, respectively, by weight.

Protective lacquer layer 23 is formed by gravure printing the following lacquer composition onto wax release layer 15 and then heating the deposited layer, causing the volatile components thereof to evaporate and leaving only the non-volatile components thereof to make up lacquer layer 23:

| Component | Percentage by weight |
|---|---|
| ViTEL ® 2300 polyester resin | 15.75 |
| ViTEL ® 5545 polyester resin | 5.25 |
| PARLON S-20 chlorinated rubber (Sanyo Kokusaku Pulp Co., Ltd., Tokyo, Japan) | 4.16 |
| CYMEL 303 melamine resin | 2.90 |
| CYCAT ® 4040 cross-linking catalyst (solution of toluene sulfonic acid in isopropanol commercially available from Cytec Industries, Inc., West Paterson, NJ) | 0.29 |
| toluene | 37.07 |
| methyl ethyl ketone (MEK) | 34.18 |
| isopropanol | 0.29 |
| dye | 0.11 |

Ink design layer 25 of transfer portion 21 comprises a conventional polyamide ink. Ink design layer 25 is formed in the conventional manner by gravure printing an ink composition comprising a polyamide resin, a suitable pigment or dye and one or more suitable volatile solvents onto one or more desired areas of lacquer layer 23. After application of the ink composition onto lacquer layer 23, the deposited layer is heated, causing the volatile solvent component(s) of the ink solvent system to evaporate and leaving only the non-volatile components thereof to form layer 25.

Adhesive layer 27 of transfer portion 21 comprises nitrocellulose (preferably having a nitrogen content of about 12%) and a clear alcohol soluble soft polyamide resin of the type that is commercially available from Henkel Corp. (Minneapolis, Minn.), that is based on dimerized vegetable acid and aliphatic polyamines and that has a Brookfield viscosity at 160° C. of 4–7 poise, a softening point of 105–115° C. and a Gardner color (maximum) of 7.

Adhesive layer 27 is formed by gravure printing the following composition over ink layer 25 and onto the surrounding area of wax release layer 15 and then heating the deposited layer, causing the volatile components thereof to evaporate and leaving only the non-volatile components thereof to make up adhesive layer 27:

| Component | Percentage by weight |
|---|---|
| above-described polyamide resin | 31.75 |
| nitrocellulose (35% solids in ethyl acetate) | 9.0 |
| isopropanol | 47.43 |
| n-propyl acetate (or ethyl acetate) | 11.75 |
| dye | 0.063 |

The amount, by weight, of the polyamide resin in the aforementioned formulation can be varied anywhere between about 25–35%, with little or no discernible negative impact. Similarly, the amount, by weight, of nitrocellulose in the aforementioned formulation can be varied anywhere between about 5–15%, with little or no discernible negative impact.

Label 11 is particularly well-suited for use with treated low-density polyethylene articles, including treated LDPE containers. Application of label 11 to such items is preferably performed in the conventional thermal-transfer manner by contacting adhesive layer 27 to the treated low-density polyethylene container or other article, while applying sufficient heat to the bottom of support 13 so as to cause transfer portion 21 (and a portion of wax release layer 15) to be released from support 13 and so as to cause adhesive layer 27 to become heat-activated for bonding of transfer portion 21 (and said portion of wax release layer 15) to the article.

Label 11 was used to decorate a treated low-density polyethylene container by conventional thermal transfer (including post-flaming). The transfer portion 21 of label 11 (together with a portion of wax release layer 15) transferred well from support 13 to the LDPE container, and the thus transferred transfer portion 21 exhibited good interlayer adhesion and good adhesion to the LDPE container, as measured by the above-described tape test. In addition, the thus labelled LDPE container possessed good "wet-flex," as measured by the above-described "wet-flex" test. Moreover, the thus labelled LDPE container exhibited good scratch-resistance when tested in the following manner: two such labelled containers were placed in a Southerland Ink Rubtester apparatus, and the respective labels on the two containers were rubbed together 100 times. The labels were then visually inspected for scratches.

Unfortunately, however, when the transfer portion 21 of the labelled LDPE container was brought into contact with animal fats, grease and the like, and the container was then subjected to flexing, the transfer portion 21 quickly degraded and easily became separated from its associated LDPE container.

Figure 2:
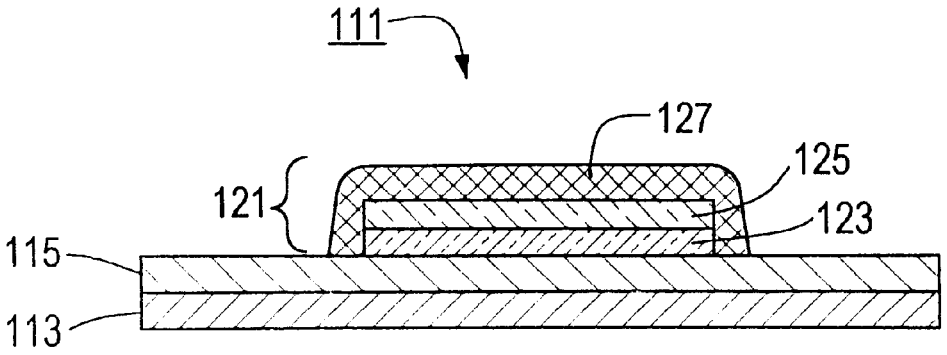
FIG. 2 is a schematic section view of one embodiment of a heat-transfer label constructed according to the teachings of the present invention that is particularly well-suited for use with treated low-density polyethylene surfaces.

Referring now to FIG. 2, there is shown a schematic section view of one embodiment of a heat-transfer label constructed according to the teachings of the present invention, the heat-transfer label being particularly well-suited for use with treated low-density polyethylene surfaces and exhibiting both strong resistance to degradation from animal fats and the like and good scratch-resistance, the heat-transfer label being represented generally by reference numeral 111.

Label 111 comprises a support 113. Support 113 is preferably a paper carrier web, but could also be a polypropylene film or other suitable substrate. Label 111 also preferably comprises a conventional wax release layer 115 overcoated on top of support 113 at approximately 6–8 lbs. wax/3000 square feet of support.

Label 111 further comprises a transfer portion 121. Transfer portion 121, in turn, preferably includes a protective lacquer layer 123 printed directly on top of a portion of wax release layer 115, an ink design layer 125 printed onto a desired area of lacquer layer 123, and a heat-activatable adhesive layer 127 printed over design layer 125 and onto a surrounding portion of wax release layer 115.

Protective lacquer layer 123 preferably comprises a pair of cross-linked polyester resins and a cross-linked vinyl resin. One of the two cross-linked polyester resins preferably comprises a polyester resin of the type commercially available as ViTEL® 2300 polyester resin and a cross-linking agent in the form of CYMEL 303 hexamethoxymethylmelamine resin. The other of the two cross-linked polyester resins preferably comprises a polyester resin of the type commercially available as ViTEL® 5545 polyester resin and a cross-linking agent in the form of CYMEL 303 hexamethoxymethylmelamine resin. The cross-linked vinyl resin preferably comprises a vinyl resin of the type commercially available as VAGH vinyl resin (a vinyl resin solution available from Union Carbide Chemicals, Danbury, Conn. having a polymer composition by % wt of 90 VCl, 4 VAc and 6 vinyl alcohol, an average molecular weight of 27,000, a glass transition temperature of 79° C., a specific gravity ASTM D792 of 1.39 and a solution viscosity at 25° C. of 1000 cP) and a cross-linking agent in the form of CYMEL 303 hexamethoxymethylmelamine resin.

As will hereinafter be seen, in forming protective lacquer layer 123, said ViTEL® 2300 and ViTEL® 5545 resins are preferably added in a 3:1 ratio, respectively, by weight; however, a 10% variation on either side of said ratio can be tolerated with little or no discernible effect. Moreover, the weight ratio of VAGH vinyl resin to the combined weight of ViTEL® 2300 and 5545 polyester resins in the formulations used to make layer 123 is preferably about 1:1, but can range anywhere from about 55% vinyl/45% polyester to about 45% vinyl/55% polyester without a discernible change in grease-resistance and scratch-resistance. If, however, the vinyl component is reduced to below about 45%, the label will readily be degraded following contact with grease, and if the polyester component is reduced to below about 45%, the label will exhibit poor scratch-resistance when tested in the manner described above.

To form lacquer layer 123, a suitable lacquer composition is deposited onto a desired area of wax release layer 115, preferably by gravure printing or a similar technique. After deposition of the lacquer composition on the desired area of wax release layer 115, the deposited layer is heated, causing the volatile solvent component(s) to evaporate and leaving only the non-volatile components thereof to make up lacquer layer 123. A particularly preferred example of such a lacquer composition consists of equal quantities, by weight, of the following two formulations:

FORMULATION NO. 1

| Component | Percentage by weight |
|---|---|
| ViTEL ® 2300 polyester resin | 15.75 |
| ViTEL ® 5545 polyester resin | 5.25 |
| PARLON S-20 chlorinated rubber | 4.16 |
| CYMEL 303 melamine resin | 2.90 |
| CYCAT 4040 cross-linking catalyst | 0.29 |
| toluene | 37.07 |
| methyl ethyl ketone (MEK) | 34.18 |
| isopropanol | 0.29 |
| green dye | 0.11 |

FORMULATION NO. 2

| Component | Percentage by weight |
|---|---|
| VAGH vinyl resin | 20 |
| CYMEL 303 melamine resin | 2 |
| MEK | 63 |
| toluene | 15 |

It should be noted that the amount, by weight, of CYMEL 303 resin in Formulation No. 2 may be varied between about 1.2–2.5% of the total formulation while keeping the amount of VAGH resin constant, with little or no discernible negative impact.

It should also be understood that, by the time that Formulations No. 1 and No. 2 are combined, all cross-linking of the respective polyester and vinyl resins contained therewithin should be complete.

Ink design layer 125 of transfer portion 121 preferably comprises a conventional polyamide ink. Ink design layer 125 is formed in the conventional manner by depositing, by gravure printing or the like, an ink composition comprising a polyamide resin, a suitable pigment or dye and one or more suitable volatile solvents onto one or more desired areas of lacquer layer 123. After application of the ink composition onto lacquer layer 123, the deposited layer is heated, causing the volatile solvent component(s) of the ink solvent system to evaporate and leaving only the non-volatile components thereof to form layer 125.

Adhesive layer 127 of label 111 is preferably identical to adhesive layer 27 of label 11 and is preferably made in the same fashion thereto.

Label 111 is particularly well-suited for use with treated low-density polyethylene articles, including treated LDPE containers. Application of label 111 to such items is preferably performed in the conventional thermal-transfer manner by contacting adhesive layer 127 to the treated low-density polyethylene container or other article, while applying sufficient heat to the bottom of support 113 so as to cause transfer portion 121 (and a portion of wax release layer 115) to be released from support 113 and so as to cause adhesive layer 127 to become heat-activated for bonding of transfer portion 121 (and said portion of wax release layer 115) to the article.

Label 111, made using the particularly preferred formulations for lacquer layer 123, was used to decorate a treated low-density polyethylene container by conventional thermal transfer (including post-flaming). The transfer portion 121 of label 111 (together with a portion of wax release layer 115) transferred well from support 113 to the LDPE container, and the thus transferred transfer portion 121 exhibited good interlayer adhesion and good adhesion to the LDPE container, as measured by tape test. In addition, the thus labelled LDPE container possessed good "wet-flex" and good scratch-resistance. Moreover, when the transfer portion 121 of the labelled LDPE container was brought into contact with animal fats, grease and the like, and the container was then subjected to flexing, the transfer portion 121 unexpectedly exhibited resistance to degradation and separation from its associated LDPE container in a manner far superior to that exhibited by transfer portion 21 of label 11 under the same conditions.

The embodiments of the present invention recited herein are intended to be merely exemplary and those skilled in the art will be able to make numerous variations and modifications to it without departing from the spirit of the present invention. For example, to achieve optimal label transfer portion integrity and optimal adherence between a label transfer portion and an article, even under conditions of chemical and/or mechanical degradation, one generally seeks to maximize the adhesion between the label transfer portion and the article and generally seeks to maximize the interlayer adhesion of the various layers of the label transfer portion. Accordingly, the particular types of materials used in the adhesive, ink and protective lacquer layers may be selected to optimize interlayer adhesion, article adhesion, and/or mechanical and chemical resistance suitable for the intended use of the article. In addition, the types of materials used in the various layers of the label transfer portion may be selected with an eye towards the particular type of coating and/or printing processes that are to be used in the manufacture of the label. Notwithstanding the above, certain variations and modifications, while producing less than optimal results, may still produce satisfactory results. All such variations and modifications are intended to be within the scope of the present invention as defined by the claims appended hereto.

What is claimed is:

1. A heat-transfer label comprising:

(a) a support;

(b) a wax release layer over said support; and (c) a transfer portion over said wax release layer to be transferred from the support to an article upon application of heat to the support while the transfer portion is in contact with the article, said transfer portion comprising (i) a protective lacquer layer, said protective lacquer layer comprising a first cross-linked polyester resin and a cross-linked vinyl resin, (ii) an ink layer over said protective lacquer layer, and (iii) an adhesive layer over said ink layer.

2. The heat-transfer label as claimed in claim 1 wherein said ink layer comprises a polyamide ink and wherein said adhesive layer comprises a polyamide resin.

3. The heat-transfer label as claimed in claim 2 wherein said polyamide resin is a clear alcohol soluble polyamide resin based on dimerized vegetable acid and aliphatic polyamines and having a Brookfield viscosity at 160° C. of 4–7 poise, a softening point of 105–115° C. and a maximum Gardner color of 7.

4. The heat-transfer label as claimed in claim 3 wherein said adhesive layer further comprises nitrocellulose.

5. The heat-transfer label as claimed in claim 4 wherein said polyamide resin constitutes about 78%, by weight of said adhesive layer and nitrocellulose constitutes about 22%, by weight, of said adhesive layer.

6. The heat-transfer label as claimed in claim 1 wherein each of said first cross-linked polyester resin and said cross-linked vinyl resin is cross-linked by a melamine resin.

7. The heat-transfer label as claimed in claim 6 wherein said melamine resin is hexamethoxymethylmelamine resin.

8. The heat-transfer label as claimed in claim 1 wherein said protective lacquer layer further comprises a second cross-linked polyester resin.

9. The heat-transfer label as claimed in claim 8 wherein one of said first and said second cross-linked polyester resins comprises a copolyester resin having a high tensile strength of 8000 psi, a low elongation of 7%, a 79 D scale Shore Durometer hardness, and a 156° C. ring and ball melt flow point and the other of said first and said second cross-linked polyester resins comprises an amber thermoplastic, high molecular weight, linear saturated polyester resin that is a highly flexible amorphous polymer, tacky at room temperature, with high elongation and low tensile values.

10. The heat-transfer label as claimed in claim 9 wherein the ratio, by weight, of said copolyester resin to said amber thermoplastic, high molecular weight, linear saturated polyester resin is about 3:1, respectively.

11. The heat-transfer label as claimed in claim 10 wherein said cross-linked vinyl resin comprises a vinyl resin that is a polymer composition by % wt of 90 VCl, 4 VAc and 6 vinyl alcohol, an average molecular weight of 27,000, a glass transition temperature of 79° C., a specific gravity ASTM D792 of 1.39 and a solution viscosity at 25° C. of 1000 cP.

12. The heat-transfer label as claimed in claim 11 wherein the ratio, by weight, of the vinyl component of said cross-linked vinyl resin to the combined weight of the polyester components of said first and second cross-linked polyester resins is between approximately 45:55 and 55:45.

13. A transfer portion of a heat-transfer label, said transfer portion comprising:

(a) a protective lacquer layer, said protective lacquer layer comprising a first cross-linked polyester resin and a cross-linked vinyl resin, (b) an ink layer over said protective lacquer layer, and (c) an adhesive layer over said ink layer.

14. The transfer portion of claim 13 wherein said ink layer comprises a polyamide ink and wherein said adhesive layer comprises a polyamide resin.

15. The transfer portion as claimed in claim 14 wherein said polyamide resin is a clear alcohol soluble polyamide resin based on dimerized vegetable acid and aliphatic polyamines and having a Brookfield viscosity at 160° C. of 4–7 poise, a softening point of 105–115° C. and a maximum Gardner color of 7.

16. The transfer portion as claimed in claim 15 wherein said adhesive layer further comprises nitrocellulose, said polyamide resin constituting about 78%, by weight of said adhesive layer and nitrocellulose constituting about 22%, by weight, of said adhesive layer.

17. The transfer portion as claimed in claim 13 wherein said protective lacquer layer further comprises a second cross-linked polyester resin and wherein each of said first cross-linked polyester resin, said second cross-linked polyester resin and said cross-linked vinyl resin is cross-linked by a melamine resin.

18. The transfer portion as claimed in claim 17 wherein said melamine resin is hexamethoxymethylmelamine resin.

19. The transfer portion as claimed in claim 18 wherein one of said first and said second cross-linked polyester resins comprises a copolyester resin having a high tensile strength of 8000 psi, a low elongation of 7%, a 79 D scale Shore Durometer hardness, and a 156° C. ring and ball melt flow point and the other of said first and said second cross-linked polyester resins comprises an amber thermoplastic, high molecular weight, linear saturated polyester resin that is a highly flexible amorphous polymer, tacky at room temperature, with high elongation and low tensile values.

20. The transfer portion as claimed in claim 19 wherein the ratio, by weight, of said copolyester resin to said amber thermoplastic, high molecular weight, linear saturated polyester resin is about 3:1, respectively.

21. The transfer portion as claimed in claim 20 wherein said cross-linked vinyl resin comprises a vinyl resin that is a polymer composition by % wt of 90 VCl, 4 VAc and 6 vinyl alcohol, an average molecular weight of 27,000, a glass transition temperature of 79° C., a specific gravity ASTM D792 of 1.39 and a solution viscosity at 25° C. of 1000 cP.

22. The transfer portion as claimed in claim 21 wherein the ratio, by weight, of the vinyl component of said cross-linked vinyl resin to the combined weight of the polyester components of said first and second cross-linked polyester resins is between approximately 45:55 and 55:45.

23. A heat-transfer label well-suited for treated low-density polyethylene articles, said heat-transfer label comprising:

(a) a support;

(b) a wax release layer over said support; and (c) a transfer portion over said wax release layer to be transferred from the support to an article upon application of heat to the support while the transfer portion is in contact with the article, said transfer portion comprising (i) a protective lacquer layer, said protective lacquer layer comprising a first cross-linked polyester resin, a second cross-linked polyester resin and a cross-linked vinyl resin, said first cross-linked polyester resin comprising a first polyester component, said first polyester component being an amber thermoplastic, high molecular weight, linear saturated polyester resin that is a highly flexible amorphous polymer, tacky at room temperature, with high elongation and low tensile values, said second cross-linked polyester resin comprising a second polyester component, said second polyester component being a copolyester resin having a high tensile strength of 8000 psi, a low elongation of 7%, a 79 D scale Shore Durometer hardness, and a 156° C. ring and ball melt flow point, said first and second polyester components being present in said protective lacquer layer in a weight ratio of about 1:3, respectively, said cross-linked vinyl resin comprising a vinyl component, said vinyl component being a polymer composition by % wt of 90 VCl, 4 VAc and 6 vinyl alcohol, an average molecular weight of 27,000, a glass transition temperature of 79° C., a specific gravity ASTM D792 of 1.39 and a solution viscosity at 25° C. of 1000 cP, the ratio of said vinyl component to the total of said first and second polyester components in said protective lacquer layer being between approximately 55:45 and 45:55, (ii) an ink layer over said protective lacquer layer, said ink layer comprising a polyamide ink, and (iii) an adhesive layer over said ink layer, said adhesive layer comprising nitrocellulose and a polyamide resin, said polyamide resin being a clear alcohol soluble polyamide resin based on dimerized vegetable acid and aliphatic polyamines, said polyamide resin having a Brookfield viscosity at 160° C. of 4–7 poise, a softening point of 105–115° C. and a Gardner color of 7, said polyamide resin constituting about 78%, by weight of said adhesive layer, nitrocellulose constituting about 22%, by weight, of said adhesive layer.

24. The heat-transfer label as claimed in claim 23 wherein each of said first and second cross-linked polyester resins and said cross-linked vinyl resin is cross-linked by a melamine resin.

25. The heat-transfer label as claimed in claim 24 wherein said melamine resin is hexamethoxymethylmelamine resin.

* * * * *